US005842795A

United States Patent [19]

Narita et al.

[11] Patent Number: 5,842,795

[45] Date of Patent: Dec. 1, 1998

[54] PRINTER WITH DRIVE MECHANISM

[75] Inventors: Hiroshi Narita; Noboru Otsuki, both of Nagano, Japan

[73] Assignee: Seiko Epson Corporation, Tokyo, Japan

[21] Appl. No.: 815,201

[22] Filed: Mar. 12, 1997

[30] Foreign Application Priority Data

Mar. 12, 1996 [JP] Japan ..... 8-552212

[51] Int. Cl.[6] ..... B41J 23/34

[52] U.S. Cl. ..... 400/185; 400/283; 400/322

[58] Field of Search ..... 400/283, 185, 400/157, 285, 322, 328, 568, 569; 74/665 GD

[56] References Cited

U.S. PATENT DOCUMENTS

| | | | |
|---|---|---|---|
| 3,951,247 | 4/1976 | Montanari | 197/1 R |
| 4,376,585 | 3/1983 | Fromme et al. | 400/185 |
| 4,869,607 | 9/1989 | McAdams | 400/222 |
| 4,886,384 | 12/1989 | Harry | 400/223 |
| 4,948,273 | 8/1990 | Tezuka et al. | 400/185 |

FOREIGN PATENT DOCUMENTS

| | | | |
|---|---|---|---|
| 62-145262 | 6/1987 | Japan | G03G 15/01 |
| 4-358173 | 12/1992 | Japan | G03G 15/01 |
| 6-110290 | 4/1994 | Japan | G03G 15/01 |
| 2 206 847 | 1/1989 | United Kingdom | B41J 23/02 |

OTHER PUBLICATIONS

Patent Abstracts of Japan, vol. 014, No. 203 (M–0966), Apr. 25, 1990 & JP 02 041282 A (NEC Home Electron LTD), Feb. 9, 1990 *Abstract.

Patent Abstracts of Japan, vol. 096, No. 006, Jun. 28, 1996 & JP 08 034145 A (Matsushita Electric Ltd), Feb. 6, 1996, *Abstract.

Patent Abstracts of Japan, vol. 096, No. 003, Mar. 29, 1996 & JP 07 309050 A (Seiko Epson Corp), Nov. 28, 1995, *Abstract.

*Primary Examiner*—Edgar S. Burr
*Assistant Examiner*—Dave A. Ghatt
*Attorney, Agent, or Firm*—Sughrue, Mion, Zinn, Macpeak & Seas, PLLC

[57] ABSTRACT

A printer including a driving shaft having first, second and third worms for feeding a recording paper, advancing a printing ribbon, and moving a carriage, respectively. The third worm for moving the carriage may be replaced by a belt. The driving shaft may include two separate portions, with the first, second and third worms connected to ends of the separate portions. The driving shaft may be rotatably supported adjacent the first, second and third worms.

15 Claims, 10 Drawing Sheets

FIG. 6(a)
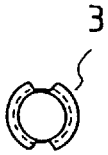
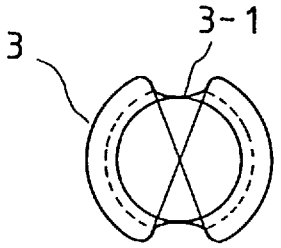
FIG. 6(b)
FIG. 6(c)
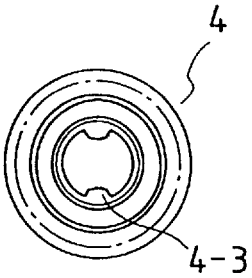
FIG. 6(d)
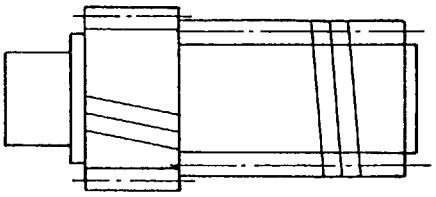
FIG. 6(e)
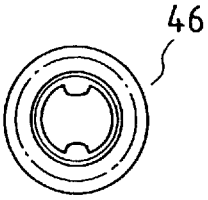
FIG. 6(f)
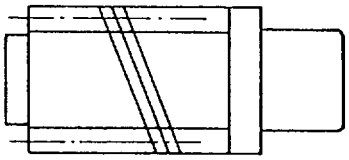
FIG. 6(g)
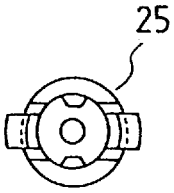
FIG. 6(h)
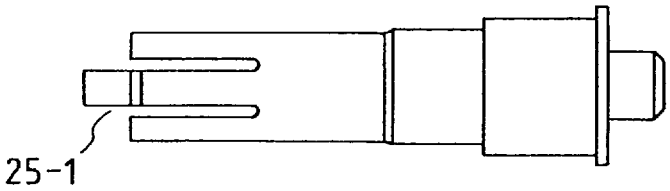

PRINTER WITH DRIVE MECHANISM

BACKGROUND OF THE INVENTION

The invention relates to a printer of an electronic cash register or the like which is used in, for example, a POS (Point-Of-Sale) system.

A typical example of the conventional art will be described with reference to FIG. 14. The rotation driving force of a motor 61 is transmitted from a gear 64 having a worm and a bevel gear to a driving pulley gear 65 for driving a belt which reciprocally moves a printing head, and also to a driving gear 66 for a ribbon driving mechanism, through a first reduction gear 62 and a transmission gear 63. The rotation driving force of the motor 61 is transmitted also to a paper feed gear 73 for driving a paper feeding mechanism, through the first reduction gear 62, a second reduction gear 71, and a third reduction gear 72.

Generally, the rotation driving force of a motor is subjected to a speed reduction process by using a power transmission mechanism configured by a combination of spur gears, in order to drive a printing mechanism and a paper feeding mechanism which require a large torque.

Recently, printers are requested to be reduced in size. In order to meet the request, a motor itself is miniaturized, and the torque required by paper feeding and printing mechanisms is ensured by increasing the reduction ratio of gears.

In the printer described above, in order to obtain a sufficient reduction ratio, parts constituting a large gear ratio are used, or a mechanism in which many reduction gears are combined in multiple stages is employed. In the former case, the parts are large in size, and, in the latter case, the parts are large in number. In both the cases, therefore, the space necessary for the speed reduction is large, thereby producing a problem in that it is difficult to reduce the size of a printer.

SUMMARY OF THE INVENTION

The invention has been conducted in view of the problem. It is an object of the invention to provide a printer having a power transmission mechanism which requires a small space and can realize a large speed reduction.

In order to attain the object above and others, the invention provides a printer which comprises carriage driving means for moving a carriage on which printing means is mounted in a direction of a line of printing, and paper feeding means for recording paper, a driving shaft which is rotated by a motor; wherein the drive shaft has at least two worms selected from a first worm which transmits a rotation force of the driving shaft to the paper feeding means, a second worm which transmits the rotation force of the driving shaft to the carriage driving means and a third worm which transmits the rotation force of the driving shaft to ink ribbon driving means for moving an ink ribbon which is to be transferred to the recording paper.

According to another aspect of the invention, there is provided a printer wherein lead angles of at least two of the first, second and third worms are equal in direction to each other.

According to a further aspect of the invention, there is provided a printer wherein the motor has a fourth worm on a motor shaft, and a worm gear which meshes with the fourth worm is fixed to the driving shaft.

According to a further aspect of the invention, there is provided a printer wherein the driving shaft is rotatably supported in the vicinity of at least one of the first, second and third worms.

According to a further aspect of the invention, there is provided a printer wherein the driving shaft is divided into two or more portions, at least one of the first, second and third worms being disposed on one of the portions which is on an end side.

In the thus configured invention, since the plural worms are disposed on the single driving shaft, it is possible to attain a large reduction ratio, and power transmission to mechanisms of the printer can be configured without requiring a large space. Furthermore, the number of components is very small. Consequently, portions where the gears mesh with each other can be reduced in number and generation of noises caused by backlash of the gears can be reduced to a very low level.

Furthermore, depending on the respective loads, the worms apply reaction forces to the driving shaft in the same direction, and hence the driving shaft does not fluctuate in the axial direction, so as to be stabilized. As a result, the carriage is stably transported, so that the printing quality is enhanced, and the vibration due to the plays of the gears is reduced. Therefore, generation of noises caused by backlash of the gears can be further suppressed.

Still further, when also the transmission from the motor is realized by a meshing operation performed by a worm, the speed reduction can be further effectively attained.

Still further, when the vicinity of the worm which causes the driving shaft to deflect is supported, the deflection is reduced. Therefore, the vibration of the shaft is reduced, and hence the rotation can be smoothly transmitted. Since the engaging degree of the worm is ensured, moreover, also the durability of the gear is improved.

Furthermore, it is not necessary for the worm to be moved to the vicinity of the middle of the shaft when the shaft is assembled into the printer. Therefore, the assembly property is improved.

BRIEF DESCRIPTION OF THE DRAWINGS

FIGS. 6(*a*) to 6(*h*) show parts in example 1 of fixation of gears onto a speed reduction shaft;

DETAILED DESCRIPTION OF THE PREFERRED EMBODIMENTS

Hereinafter, an embodiment of the invention will be described in detail.

Figure 1:
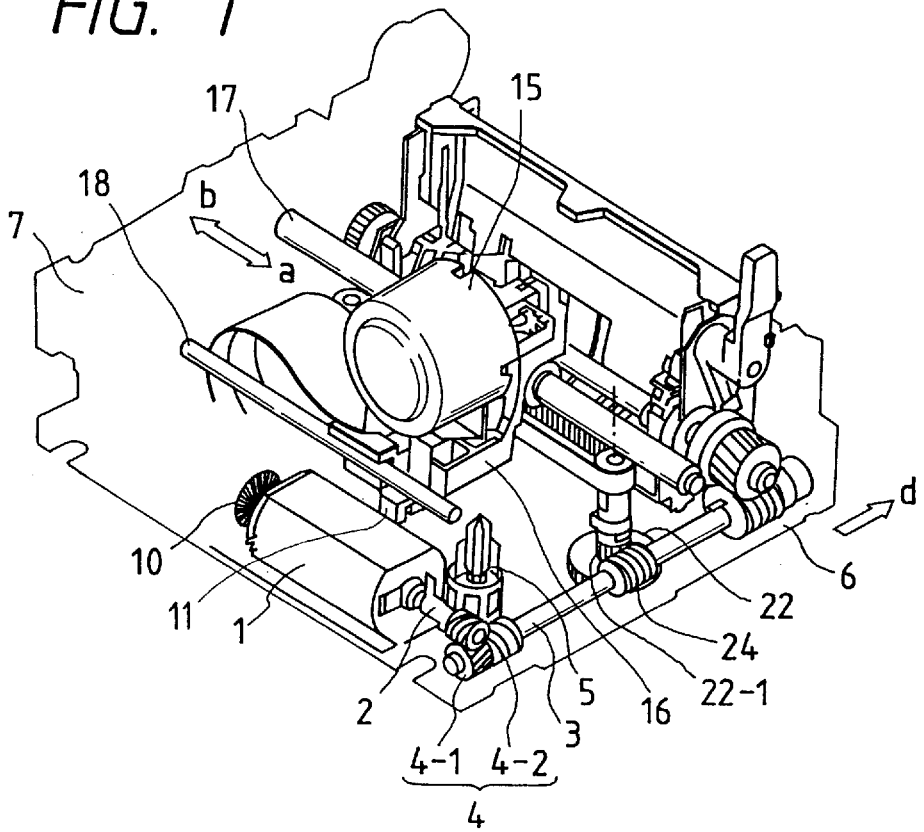
FIG. 1 is a perspective view-showing a small printer which is an embodiment of the invention, with removing away external parts.
Figure 2:
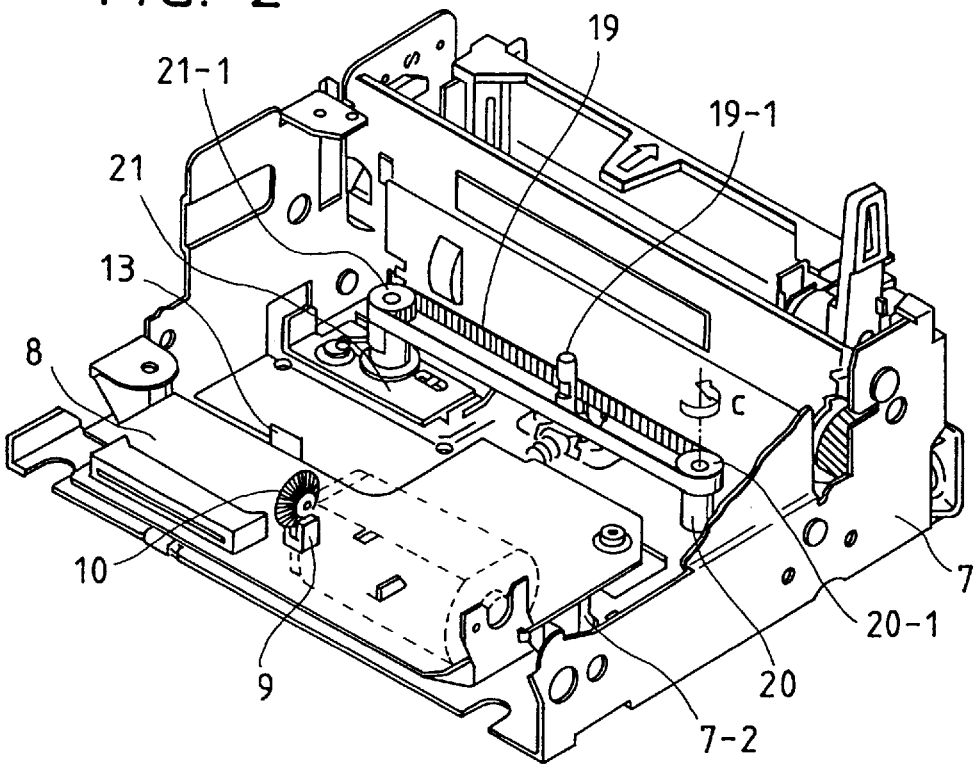
FIG. 2 is a view illustrating a printing mechanism section of the small printer of the embodiment of the invention.

FIG. 1 is a perspective view illustrating the mechanism of the whole of a printer, with removing away external parts (such as a frame 7, and a cover) from the printer, and FIG. 2 is a view illustrating a printing mechanism section.

The printer of the embodiment is mainly configured by four mechanism sections, i.e., a power transmission mechanism section, including a transmission with several sub-transmissions the printing mechanism section, a paper feeding mechanism section, and a ribbon feeding mechanism section.

As shown in FIG. 1, a motor 1 having a motor gear 2 in the form of a worm is mounted in a lateral direction with respect to the printer. The power transmission mechanism section is configured by a speed reduction shaft 3 serving as the driving shaft onto which a reduction gear 4, a pulley driving gear 24, and a paper feed clutch unit 6 are fixed, and which is disposed on the right end side of the frame 7.

In the reduction gear 4, a worm wheel portion 4-1 which meshes with the motor gear, and a worm portion 4-2 are united with each other. The worm portion 4-2 of the reduction gear 4 meshes with a worm wheel portion formed in the lower portion of a ribbon take-up shaft set 5 which drives a ribbon driving mechanism.

The pulley driving gear 24 constitutes a worm gear and meshes with a worm gear 22-1 of a pulley transmission gear 22 which is rotatably disposed on the bottom of the frame 7.

The printing mechanism section comprises a carriage 16 on which a printing head 15 is mounted, and which is moved by a carriage belt 19. The carriage belt 19 runs between a driven pulley 21-1 and a driving pulley 20-1 which are respectively disposed on the sides of the frame 7. As the printing method, the bidirectional printing method is employed in which printing is enabled during the movement of the printing head 15 in both the directions of the arrows a and b.

Figure 3:
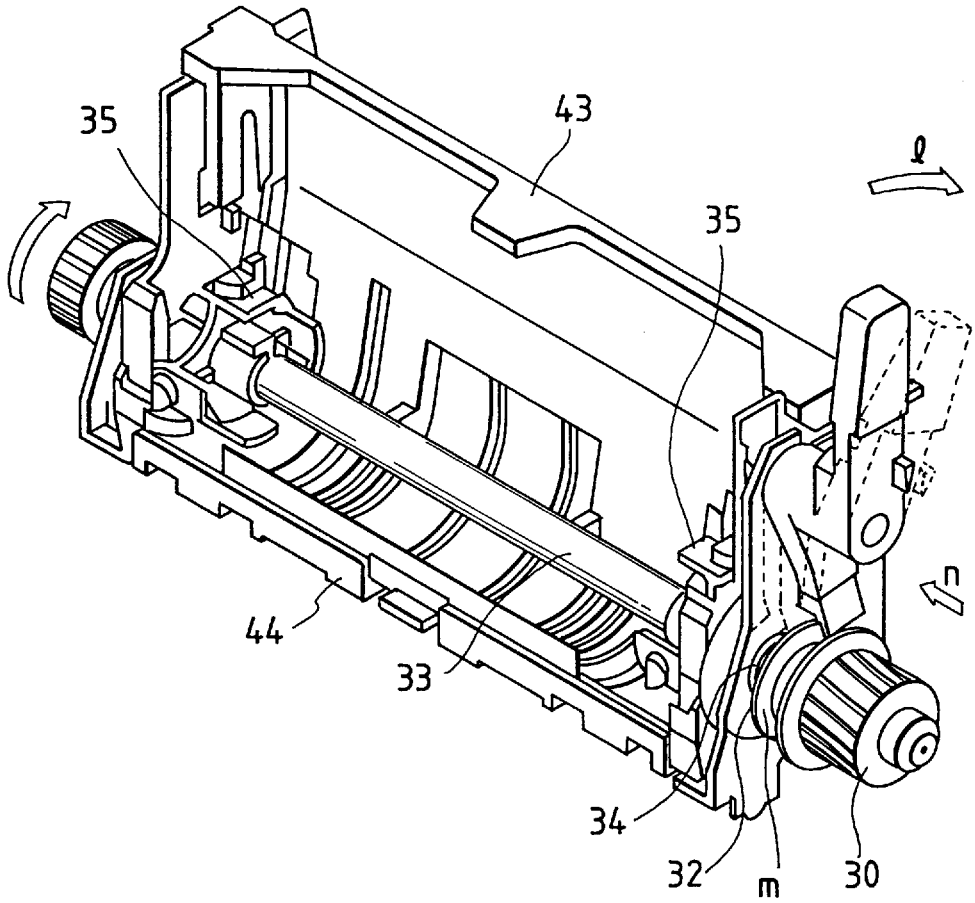
FIG. 3 is a perspective view of a paper feeding mechanism section.

FIG. 3 is a perspective view of the paper feeding mechanism section. The section will be described with reference to the figure.

The paper feeding mechanism section comprises a paper guide frame 44 disposed in the rear portion of the printer, a paper guide (inner) 43 disposed so as to oppose the guide frame 44 with being separated therefrom by a predetermined gap, and a paper feed shaft 33. The paper feed shaft 33 has sprocket wheels 35 at the lateral ends, and is rotated through the paper feed clutch unit 6. Pins which are to engage with holes formed in the side edges of recording paper are formed on the outer peripheries of the sprocket wheels 35. The paper feeding mechanism section further comprises a paper feed trigger electromagnet unit which controls the on/off operation for the power transmission of the clutch unit 6, and a release mechanism which is disposed on the paper feed shaft 33 and serves as a second clutch.

The paper feed clutch unit 6 will be described in detail with reference to FIGS. 4, 5, 7, and 8.

Figure 4:
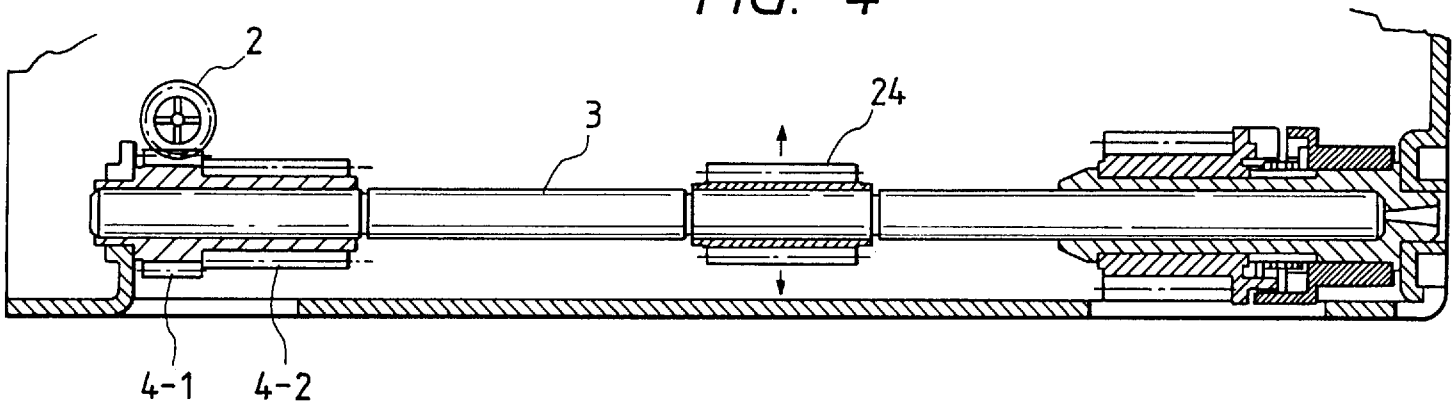
FIG. 4 is a side view of a portion supporting a speed reduction shaft in a first embodiment of the invention.
Figure 5:
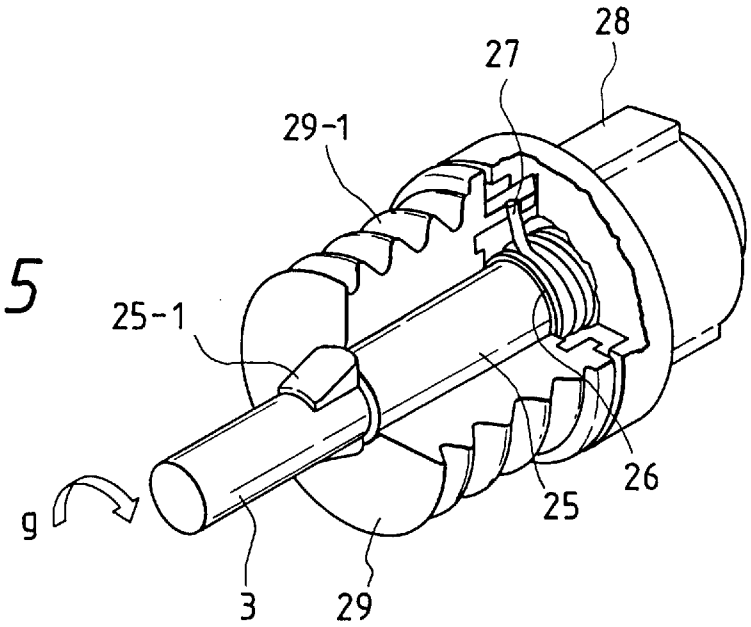
FIG. 5 is a partially cutaway perspective view of a paper feed clutch unit.
Figure 7A:
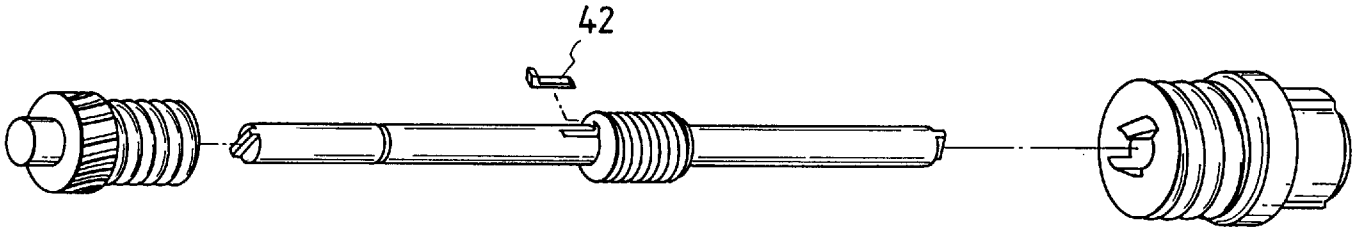
FIGS. 7(*a*) and 7(*b*) show a perspective view and a section view of example 2 of fixation of the gears onto the speed reduction shaft.
Figure 7B:
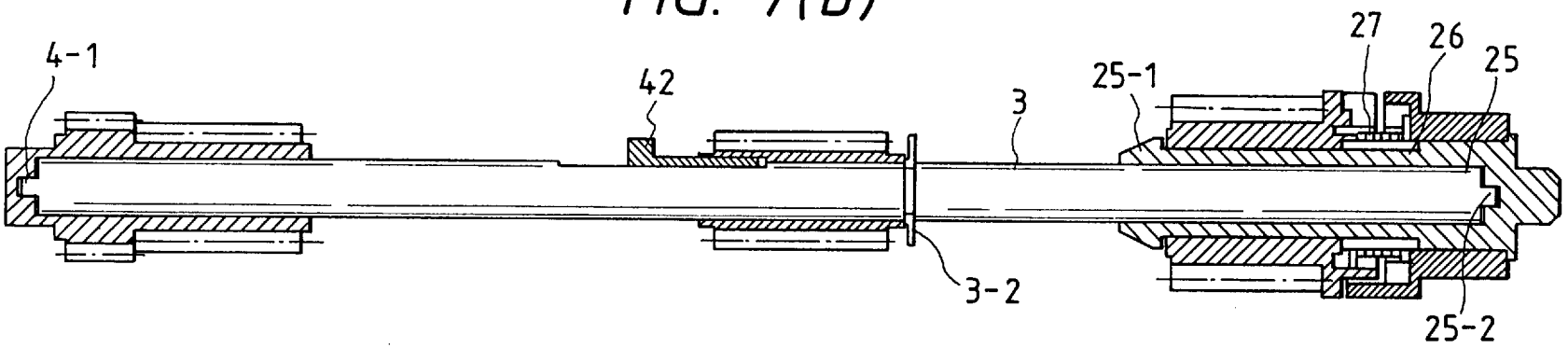
Figure 8:
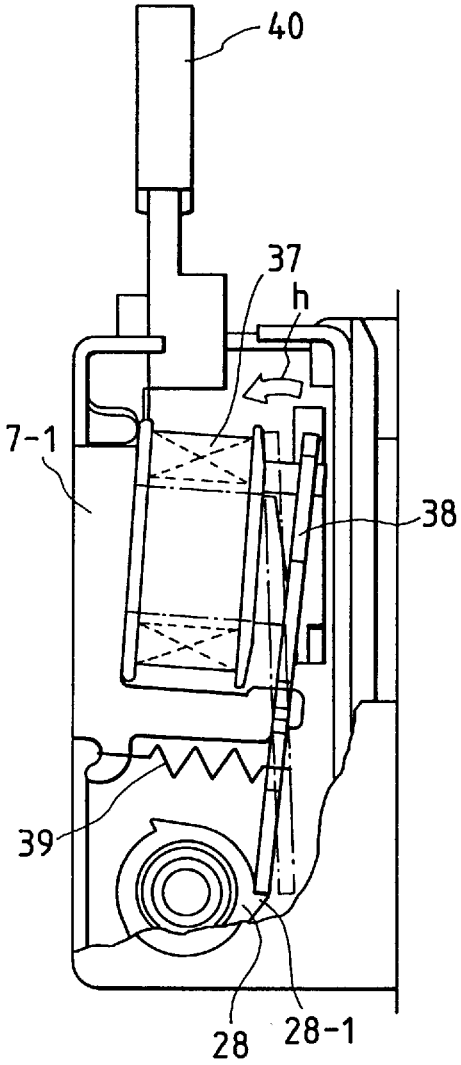
FIG. 8 is a rear view of a paper feed trigger electromagnet.

FIG. 4 is a side view of a portion supporting the speed reduction shaft in a first embodiment of the invention, FIG. 5 is a partially cutaway perspective view of the paper feed clutch unit, FIG. 7 shows a perspective view and a section view of an example of fixation of the gears onto the speed reduction shaft, and FIG. 8 is a rear view of the paper feed trigger electromagnet.

The paper feed clutch unit 6 of the embodiment is a spring clutch, and comprises: a paper feed arbor 25 fixed to the speed reduction shaft 3; a paper feed clutch spring 27 which is wound on a paper feed sleeve 26 and has arms respectively formed at the ends, the paper feed sleeve being pressingly inserted into the paper feed arbor 25 so as to be rotated integrally therewith; a paper feed ratchet wheel 28 which is rotatably supported on the paper feed arbor 25, has teeth 28-1 arranged on the outer periphery and engaging with a trigger suction plate 38, and engages with one of the arms of the clutch spring 27; and a paper feed driving gear 29 which is rotatably supported on the paper feed arbor 25, has a worm gear 29-1 formed on the outer periphery and transmitting the power to the paper feed mechanism section, and engages with the other arm of the clutch spring 27. These components are assembled into the unit while deflecting a pawl 25-1 of the paper feed arbor 25 (see FIG. 5, end view in FIG. 6(*g*) and side view in FIG. 6(*h*), and the movement of the paper feed driving gear 29 is restricted by the pawl 25-1. Therefore, the paper feed clutch unit 6 is assembled as a unit before the unit is fixed to the speed reduction shaft 3. When the unit is thereafter fixed to the speed reduction shaft 3, the pawl 25-1 is not deflected toward the center, and hence the components are prevented from being disassembled.

Figure 9:
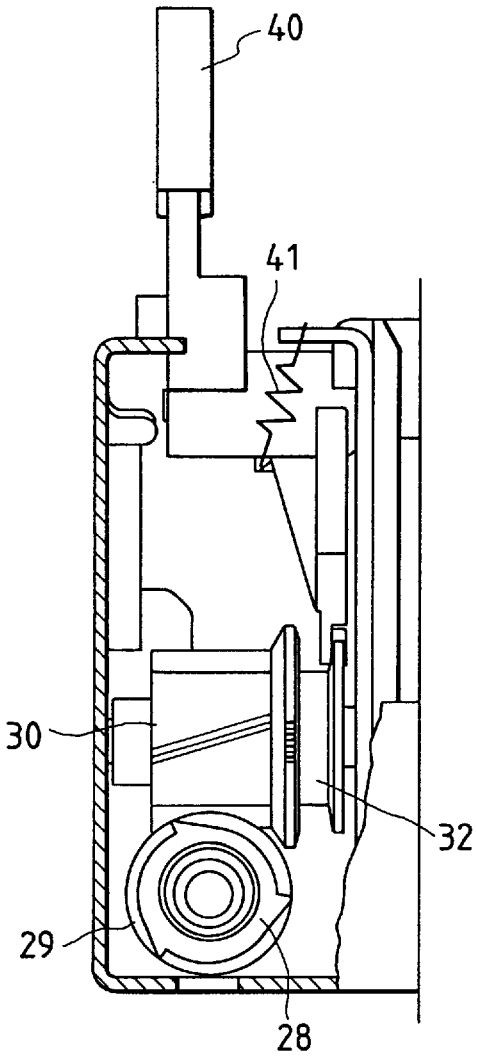
FIG. 9 is a rear view of a release mechanism.
Figure 10:
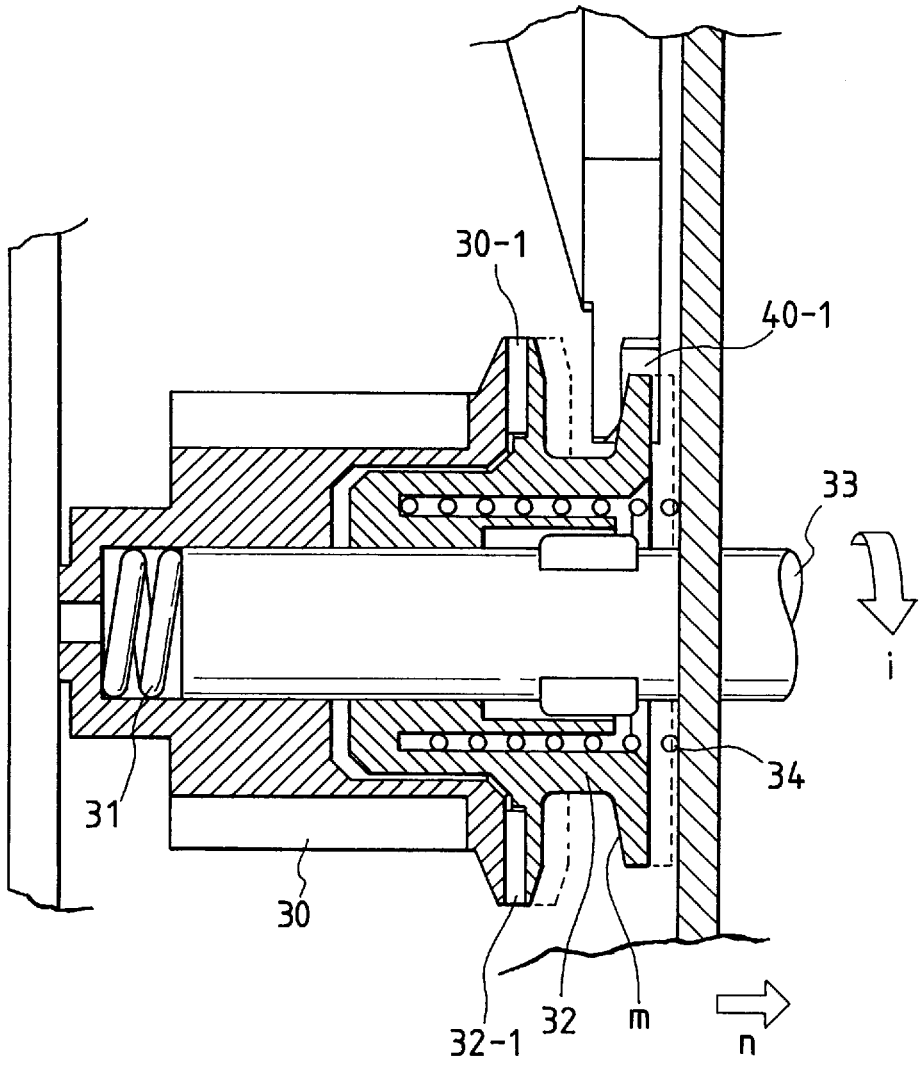
FIG. 10 is an enlarged section view of the release mechanism.

FIG. 9 is a rear view of the release mechanism, and FIG. 10 is an enlarged section view of the release mechanism.

The release mechanism comprises: a paper feed transmission gear 30 which is disposed on the paper feed shaft 33 and rotated by the paper feed driving gear 29; a paper feed clutch disc 32 which is not rotated with respect to the paper feed shaft 33 and can be moved so as to mesh with the transmission gear 30; and a release lever 40 which locates the clutch disc 32 to either of the position where the disc and the transmission gear 30 mesh with each other, and that where the disc and the transmission gear 30 do not mesh with each other.

The ribbon feeding mechanism section is configured by a ribbon cassette (not shown) in which a Mobius system is configured by an endless ribbon, and the ribbon take-up shaft set 5 which engages with a ribbon driving portion of the ribbon cassette so as to move the ribbon. The ribbon take-up shaft set 5 for the ribbon meshes with the worm portion 4-2 of the reduction gear 4 so as to be rotated.

As above mentioned, three worm 24, 4-2 and 29-1 are attached to drive shaft 3 in this embodiment. However this invention shall not limited to this embodiment, and may be effective even when the drive shaft has two worm selected from these three worms.

The operation of the thus configured printer will be described in detail.

When the motor 1 rotates, the rotation driving force of the motor is transmitted to the speed reduction shaft 3 with a speed which is largely reduced by the motor gear 2 that is a worm gear, and the reduction gear 4. The ribbon take-up shaft set 5 which meshes with the worm portion 4-2 of the reduction gear 4 is rotated with a further largely reduced speed, thereby moving the ribbon of the cassette.

The pulley driving gear 24 fixed to the speed reduction shaft 3 rotates the driving pulley 20-1 through the pulley transmission gear 22. Teeth which mesh with the carriage belt 19 serving as a timing belt are formed on the driving pulley 20-1. The carriage belt 19 which runs between the driving pulley and the driven pulley 21-1 is moved in the direction of the arrow c.

The carriage 16 on which the printing head 15 is mounted is engaged with a carriage driving shaft 19-1 fixed to the carriage belt 19, so as to be moved in the direction of the arrow a or b.

Then, printing is conducted at a desired position by using a timing signal detected by a T-detection plate 10 fixed to the shaft of the motor 1, and a position detection signal detected when an R-detector set 11 of the light transmission type fixed to the carriage 16 recognizes a projection 7-2 on the frame 7.

In the paper feed clutch unit 6 attached to the speed reduction shaft 3, since the paper feed ratchet wheel 28 is prevented from rotating by the trigger suction plate 38, the inner diameter of the paper feed clutch spring 27 is increased. Therefore, the paper feed sleeve 26 can rotate, but the clutch spring 27 cannot rotate, with the result that the rotation of the speed reduction shaft 3 is not transmitted to the paper feeding mechanism. When a trigger electromagnet 37 is energized at a desired timing, the trigger suction plate 38 swings to cancel the engagement between the plate and the tooth 28-1, so that the paper feed ratchet wheel 28 rotates. The clutch spring 27 rotates together with the paper feed sleeve 26, and the paper feed driving gear 29 is rotated by the arm of the spring.

When the energization of the trigger electromagnet 37 is terminated, the trigger suction plate 38 is caused to again engage with the paper feed ratchet wheel 28 by the force of a trigger pawl spring 39, and stops in this state. Therefore, the rotations of the paper feed ratchet wheel 28 and the paper feed driving gear 29 are stopped in the standby state by the function of the paper feed clutch spring 27.

When the paper feed driving gear 29 rotates, the paper feed transmission gear 30 rotates. In the case where the teeth 30-1 of the transmission gear 30 mesh with the teeth 32-1 of the clutch disc 32, the rotation is transmitted to the paper feed shaft 33 and the recording paper is fed by the sprocket wheels 35.

In some cases, in order to conduct an operation such as replacement of the recording paper engaged with the sprocket wheels 35, the recording paper is detached from the sprocket wheels 35. In such a case, when the tip end of the release lever 40 is rotated in the direction of the arrow 1, a cam face 40-1 of the release lever 40 pushes the engaging face m of the paper feed clutch disc 32 in the direction of the arrow n, and hence the engagement between the teeth 30-1 of the transmission gear 30 and the teeth 32-1 of the clutch disc 32 is canceled, thereby allowing the paper feed shaft 33 to freely rotate. As a result, the recording paper can be pulled out in either direction (the state indicated by the broken lines in FIG. 10). When the release lever 40 is returned to the original position, a release lever spring 41 causes the paper feed transmission gear 30 and the paper feed clutch disc 32 to mesh with each other, so that the paper feed shaft 33 and the transmission gear 30 can integrally rotate.

In the embodiment, the gears are attached to the speed reduction shaft 3 so as to always act in the direction of the arrow d or toward the rear portion of the printer. Specifically, the motor 1 rotates in a counterclockwise direction so as to rotate the reduction gear 4, and hence the speed reduction shaft 3 is urged toward the rear portion of the printer by the rotation of the motor 1. The worm portion 4-2 of the reduction gear 4 is configured so that, when a worm wheel section formed in the lower portion of the ribbon take-up shaft set 5 for driving the ribbon driving mechanism is rotated, the speed reduction shaft 3 is urged in the direction of the arrow d by the reaction force due to the rotation. The printing mechanism is driven by the pulley driving gear 24 through the pulley transmission gear 22. The pulley driving gear 24 which is a worm gear is configured so as to, also in this case, urge the speed reduction shaft 3 in the direction of the arrow d.

Also in the case where the paper feed clutch unit 6 rotates the transmission gear 30, similarly, the worm is configured so that the speed reduction shaft 3 is urged in the direction of the arrow d or toward the rear portion of the printer. In other words, all the worms disposed on the speed reduction shaft 3 are configured so that their lead angles are oriented in the same direction.

According to this configuration, when the speed reduction shaft 3 is always urged toward the rear side, the behavior of the speed reduction shaft 3 is stabilized, and, even when there is a gap in the axial direction, the quality of the printer is not affected. Therefore, it is possible to obtain an excellent printing quality.

In order to clarify the effect, for example, the motor gear and the reduction gear urge the speed reduction shaft 3 in the direction of the arrow d, the helical direction of the worm gear in the mesh of the pulley driving gear 24 and the pulley transmission gear 22 is set to be opposite (the lead angle is set to be opposite), and the speed reduction shaft 3 is then moved in the direction opposite to the direction of the arrow d or toward the front portion of the printer. Then, the speed reduction shaft 3 is moved in the direction opposite to the direction of the arrow d because of the load for moving the printing head 15. When the moving direction of the printing head 15 is inverted at the driving pulley 20-1 and the driven pulley 21-1, however, the load on the pulley driving gear 24 is abruptly reduced because of the effect of the inertia of the printing head 15, and the speed reduction shaft 3 is moved in the direction of the arrow d by the motor gear 2. Therefore, the speed reduction shaft 3 is reciprocally moved in the axial direction, and the position of the printing head 15 fails to coincide with the timing signal detected from the motor 1, with the result that the printing quality is largely lowered. The reciprocal movement of the speed reduction shaft 3 adversely affects the generation of noises, etc. In the embodiment, the configuration in which rotation of worms or worm gears disposed on the speed reduction shaft 3 always urges the speed reduction shaft 3 in one direction can solve the problem, and therefore can attain a great advantage.

As in the embodiment described above, the components constituting the power transmission mechanism in the invention are the motor gear 2, the reduction gear 4, the speed reduction shaft 3, the pulley driving gear 24, the paper feed clutch unit 6 (the paper feed driving gear 29), the ribbon take-up shaft set 5, the pulley transmission gear 22, the carriage driving pulley set 20, and the paper feed transmission gear 30, or the number of the components can be reduced to eight. The portions where gears mesh with each other are reduced to a very small number or five. The helical directions of the worms are set so that the reaction forces of the worms are caused to urge the speed reduction shaft 3 toward the rear portion of the printer (in the direction of the arrow d) by the load exerted in each of the ribbon drive, the print head drive, and the paper feed. Therefore, the plays of the gears are small, and generation of noises caused by backlash of the gears can be suppressed to a very low level.

Next, fixation of the gears onto the speed reduction shaft 3 will be described in detail with reference to FIGS. 6 and 7.

FIGS. 6(*a*) to 6(*h*) show parts in example 1 of fixation of the gears onto the speed reduction shaft, and FIGS. 7(*a*) and 7(*b*) show a perspective view and a section view of example 2 of fixation of the gears onto the speed reduction shaft.

In the embodiment, fixation of the gears to the speed reduction shaft 3 is conducted in the following manner. As shown in FIG. 6(*b*), which is an enlarged view relative to FIG.6(*a*), the speed reduction shaft 3 is a deformed shaft having a section shape in which recesses 3-1 elongating in the whole length of the shaft are formed at two symmetrical positions. In the reduction gear 4 (see end view in FIG. 6(*c*) and side view in FIG. 6(*d* ), projections 4-3 which are to engage with the recesses 3-1 are formed. The reduction gear 4 is attached to the speed reduction shaft 3 with engaging the projections 4-3 with the recesses 3-1 so that the gear cannot be rotated with respect to the shaft and can be moved in the axial direction. The movement in the axial direction is restricted by an E-type snap ring 3-2. Since the recesses are formed over the whole length of the shaft, the configuration has drawbacks such as that the strength is low and a warpage easily occurs.

As a countermeasure to the above, a configuration is employed in which, as shown in FIGS. 7(*a*) and 7(*b*), a tenon is formed on each end of the speed reduction shaft 3, fitting grooves 4-1 and 25-2 for receiving the respective tenons are respectively formed inside the reduction gear 4 and the paper feed arbor 25, and these components are then engaged with each other so as to integrally rotate. According to this configuration, the speed reduction shaft 3 is enhanced in rigidity so as to have a higher strength. The relationships between the tenons and the fitting grooves may be inverted, or the fitting grooves may be formed on the speed reduction shaft 3 and the tenons in the reduction gear 4.

As a method of enabling the pulley driving gear 24 to be rotated integrally with the speed reduction shaft 3, a method may be employed in which key ways are formed in each of the speed reduction shaft 3 and a component which is to be attached to the shaft, and a key 42 to be fitted into the key ways are used.

Next, other embodiments of the invention will be described with reference to FIGS. 11 and 12.

Figure 11:
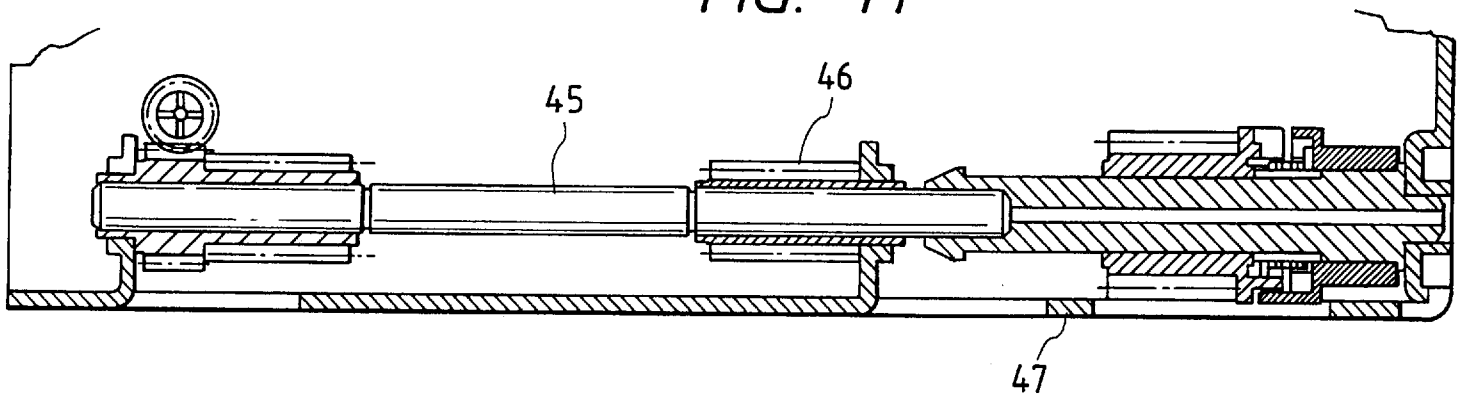
FIG. 11 is a side view of a portion supporting the speed reduction shaft in another embodiment of the invention.
Figure 12:
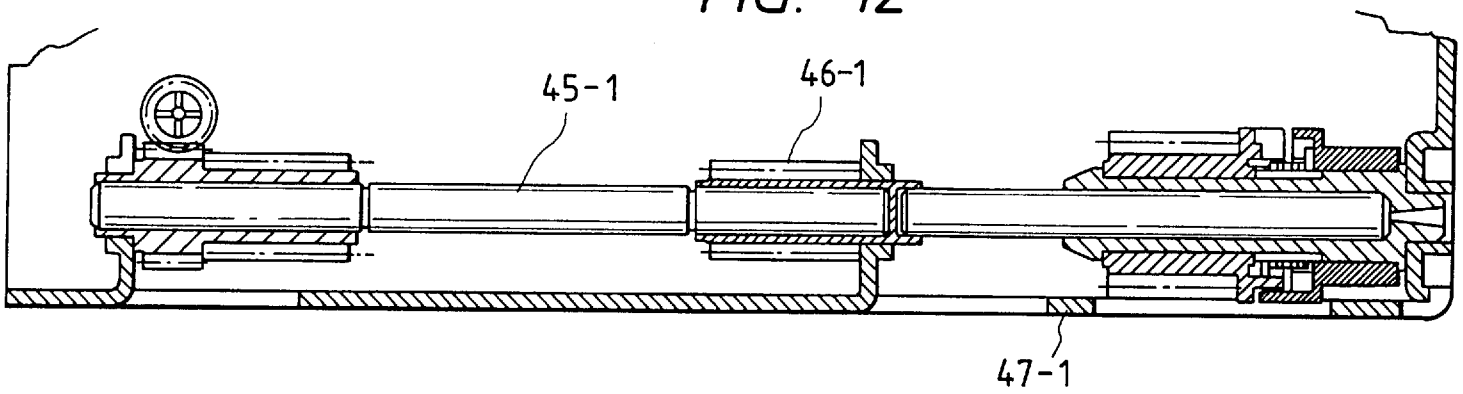
FIG. 12 is a side view of a portion supporting the speed reduction shaft in a further embodiment of the invention.

FIG. 11 is a side view of a portion supporting the speed reduction shaft in another embodiment, and FIG. 12 is a side view of a portion supporting the speed reduction shaft in a further embodiment.

In the first embodiment, the reduction gear 4, the pulley driving gear 24, and the paper feed clutch unit 6 are fixed to the single speed reduction shaft 3, and the shaft is supported at the ends or two points (FIG. 4). In the embodiment, since a warpage easily occurs in a long shaft such as the speed reduction shaft 3 during the production process of the shaft, particularly the pulley driving gear 24 disposed in the middle portion of the speed reduction shaft 3 produces a large run out (in the directions of the arrows in FIG. 4). This phenomenon increases the rotation variation of the wheel train engaged with the pulley driving gear 24.

As a countermeasure to the above, a speed reduction shaft 45 or 45-1 in FIG. 11 or 12 has a limited length which elongates to a position beyond a pulley driving gear 46 (see end view in FIG. 6(*e*) and side view in FIG. 6(*f*) or 46-1, and is rotatably supported by a raised portion formed on the bottom of a frame 47 or 47-1 with using a part of the pulley driving gear 46 or 46-1 as a bearing. According to this configuration, the pulley driving gear 46 or 46-1 produces a small run out and the rotation variation is reduced, thereby producing an effect that the accuracy of the power transmission is further enhanced. Since the engaging degree of the worm is ensured, moreover, also the durability of the gear is improved.

The embodiments of FIGS. 11 and 12 are different from each other in the configuration of the speed reduction shaft. The speed reduction shaft of the embodiment of FIG. 11 is configured in the same manner as that of the first embodiment. The embodiment of FIG. 12 is different from the embodiments in that the speed reduction shaft is divided into two portions and the pulley driving gear 46-1 is used as a joint. In the embodiment of FIG. 12, the load applied to the paper feed clutch unit can be supported by the metal shaft of high rigidity and the vicinity of the bearing. Therefore, the embodiment is more advantageous in strength than the embodiment of FIG. 11.

Since it is not necessary for the worm to be moved to the vicinity of the middle of the shaft, the assembly property is improved.

Figure 13:
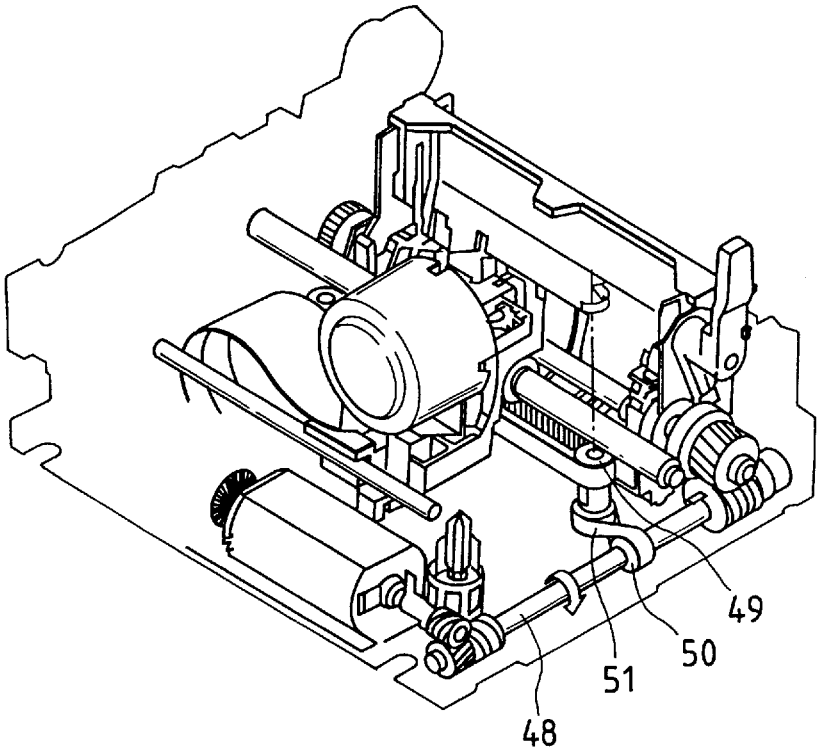
FIG. 13 is a perspective view of a still further embodiment of the invention.
Figure 14:
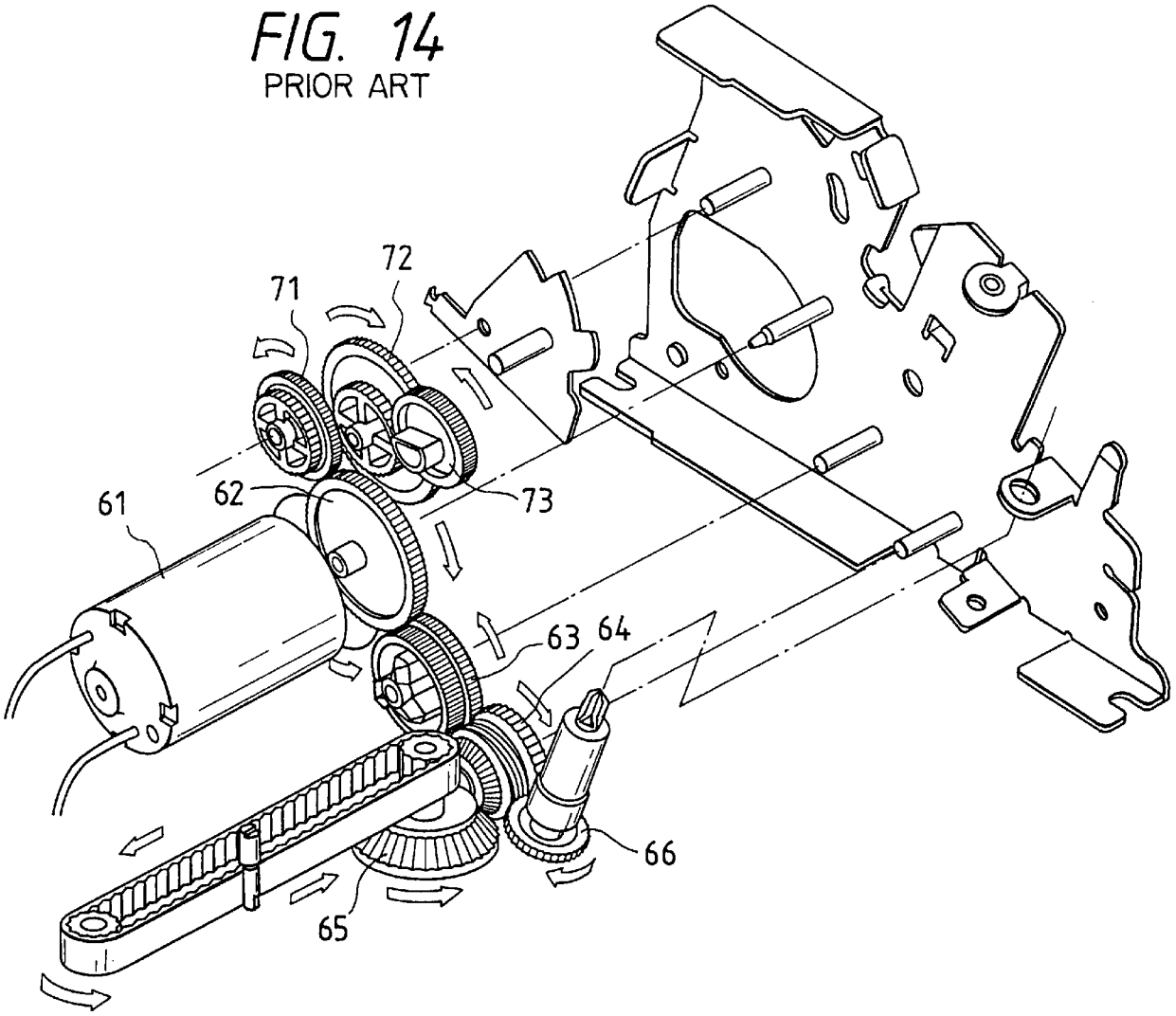
FIG. 14 PRIOR ART
FIG. 14 is a perspective view of a power transmission mechanism section of a printer of an example of the conventional art.

FIG. 13 shows a still further embodiment of the invention.

FIG. 13 is a perspective view of the whole of a printer. The printer is different from the second embodiment in that a speed reduction shaft 48 and a driving pulley 49 are rotated at a substantially same rate and a pulley driving gear 50 and the driving pulley 49 are directly coupled to each other by a timing belt 51.

In the embodiment, the use of the timing belt 51 can eliminate the rotation variation of the carriage driving pulley set 20 due to the part accuracies such as the concentricity of the worm wheel and the spur gear of the pulley transmission gear 22 in the first embodiment.

As described above, according to the invention, a transmission element other than a worm may be used on the speed reduction shaft.

The invention is not restricted to the embodiments described above, and may be modified in various manners.

In the embodiments, the recording paper has a continuous slip form having holes in the side edges and the sprocket wheels are used as the paper feeding means. Alternatively, roll-like recording paper and means for friction feed such as rollers may be used. The invention is not restricted by printing means, a printing method, etc.

In the present invention described above, since the plural worms are disposed on the single driving shaft, it is possible to attain a large reduction ratio, and power transmission to mechanisms of the printer can be configured without requiring a large space. Furthermore, the number of components is very small. Consequently, portions where the gears mesh with each other can be reduced in number and generation of noises caused by backlash of the gears can be reduced to a very low level.

Furthermore, depending on the respective loads, the worms urge the driving shaft in the same direction, and hence the driving shaft does not fluctuate in the axial direction, so as to be stabilized. As a result, the carriage is stably transported, so that the printing quality is enhanced, and the vibrations of the gears due to the plays are reduced. Therefore, generation of noises caused by backlash of the gears can be further suppressed.

The inventions set forth in embodiments are further effective.

What is claimed is:

1. A printer comprising:

a print head for printing a recording medium;

a carriage on which the print head is mounted;

a carriage moving mechanism for moving the carriage in a first direction;

a recording media feeding mechanism for transporting the recording medium in a second direction traversing the first direction;

a motor having a motor shaft; and a transmission which transmits a rotation force of the motor shaft commonly to at least the carriage moving mechanism and the recording media feeding mechanism, the transmission comprising:

a driving shaft;

a first sub-transmission which transmits the rotation force of the motor shaft to the driving shaft;

a second sub-transmission which transmits a rotation force of the driving shaft to the recording media feeding mechanism, the second sub-transmission comprising a worm fixed to the driving shaft; and a third sub-transmission which transmits the rotation force of the driving shaft to the carriage moving mechanism.

2. A printer according to claim 1, wherein the first sub-transmission comprises a worm fixed to the motor shaft, and a worm gear fixed to the driving shaft which meshes with the worm fixed to the motor shaft.

3. A printer according to claim 1, wherein the driving shaft is rotatably supported in the vicinity of the worm fixed to the driving shaft.

4. A printer according to claim 1, wherein the third sub-transmission comprises a worm fixed to the driving shaft.

5. A printer according to claim 4, wherein lead angles of the worms fixed to the driving shaft are equal in direction to each other.

6. A printer according to claim 5, wherein the first sub-transmission comprises a worm fixed to the motor shaft, and a worm gear fixed to the driving shaft which meshes with the worm fixed to the motor shaft.

7. A printer according to claim 5, wherein said driving shaft is rotatably supported in the vicinity of at least one of the worms fixed to the driving shaft.

8. A printer according to claim 1, further comprising:

an ink ribbon, disposed between the print head and the recording medium, for containing ink to be transferred to the recording medium; and an ink ribbon feeding mechanism for feeding the ink ribbon;

and wherein the transmission further comprises a fourth sub-transmission which transmits the rotation force of the driving shaft to the ink ribbon feeding mechanism.

9. A printer according to claim 8, wherein at least one of the third and fourth sub-transmissions comprises a worm fixed to the driving shaft.

10. A printer according to one of claims 8 and 9, wherein the first sub-transmission comprises a worm fixed to the motor shaft, and a worm gear fixed to the driving shaft which meshes with the worm fixed to the motor shaft.

11. A printer according to claim 9, wherein the driving shaft is rotatably supported in the vicinity of at least one of the worms fixed to the driving shaft.

12. A printer according to claim 9, wherein lead angles of at least two of the worms fixed to the driving shaft are equal in direction to each other.

13. A printer according to claim 12, wherein the first sub-transmission comprises a worm fixed to the motor shaft, and a worm gear fixed to the driving shaft which meshes with the worm fixed to the motor shaft.

14. A printer according to claim 12, wherein said driving shaft is rotatably supported in the vicinity of at least one of the worms fixed to the driving shaft.

15. A printer according to one of claims 4 to 7, 9 and 11 to 14, wherein said driving shaft is divided into two or more portions connected to each other, and at least one of the worms fixed to the driving shaft is disposed around one of the connections of the divided portions.

* * * * *

UNITED STATES PATENT AND TRADEMARK OFFICE

CERTIFICATE OF CORRECTION

PATENT NO. : 5,842,795
DATED : December 1, 1998
INVENTOR(S) : Hiroshi Narita, et al.

It is certified that error appears in the above-identified patent and that said Letters Patent is hereby corrected as shown below:

Title page,
Under "Item [30] Foreign Application Priority Data" delete:
"Mar. 12, 1996 [JP] Japan..... 8-552212" and insert
-- Mar. 12 1996 [JP] Japan..... 8-55212 --

Signed and Sealed this

Eleventh Day of September, 2001

*Attest:*

Nicholas P. Godici

NICHOLAS P. GODICI
*Acting Director of the United States Patent and Trademark Office*

*Attesting Officer*